US008685167B2

(12) United States Patent
Retsina et al.

(10) Patent No.: US 8,685,167 B2
(45) Date of Patent: Apr. 1, 2014

(54) METHOD FOR HYDROLYSIS OF BIOMASS IN PULPING SPENT LIQUOR

(75) Inventors: Theodora Retsina, Atlanta, GA (US); Vesa Pylkkanen, Atlanta, GA (US)

(73) Assignee: API Intellectual Property Holdings, LLC, Atlanta, GA (US)

( * ) Notice: Subject to any disclaimer, the term of this patent is extended or adjusted under 35 U.S.C. 154(b) by 632 days.

(21) Appl. No.: 12/397,284

(22) Filed: Mar. 3, 2009

(65) Prior Publication Data

US 2009/0226979 A1 Sep. 10, 2009

Related U.S. Application Data

(60) Provisional application No. 61/064,397, filed on Mar. 4, 2008.

(51) Int. Cl.
*C13K 1/02* (2006.01)

(52) U.S. Cl.
USPC ..... 127/37; 127/34; 127/36; 127/51

(58) Field of Classification Search
USPC ..... 127/37; 435/72, 165, 139, 105
See application file for complete search history.

(56) References Cited

U.S. PATENT DOCUMENTS

| | | | | |
|---|---|---|---|---|
| 4,278,471 | A * | 7/1981 | Whittingham | 127/37 |
| 5,777,086 | A * | 7/1998 | Klyosov et al. | 530/500 |
| 7,722,721 | B2 * | 5/2010 | Heikkila et al. | 127/46.2 |
| 2009/0023187 | A1 * | 1/2009 | Foody et al. | 435/72 |

OTHER PUBLICATIONS

"Characterization of the Ethanol-SO2 Pulping and a Preliminary Chemical Recovery Process Design". Thesis by PylKkanen. Michigan state university, 1992.*

* cited by examiner

*Primary Examiner* — Melvin C Mayes
*Assistant Examiner* — Colette Nguyen
(74) *Attorney, Agent, or Firm* — Ryan P. O'Connor

(57) ABSTRACT

A method for the hydrolysis of cellulosic materials using spent liquor. The spent liquor is derived from a pulping operation or is hydrolyzate from another cellulosic biomass process. The process can be implemented in a batch or semi continuous or continuous process. The hydrolyzate is fermented to a useful product and purified. Combustible biomass residues and chemicals are used to provide energy and chemical recovery.

21 Claims, 1 Drawing Sheet

Illustration of a flow sheet example of the invention process, noting that the process steps may be in other sequences.

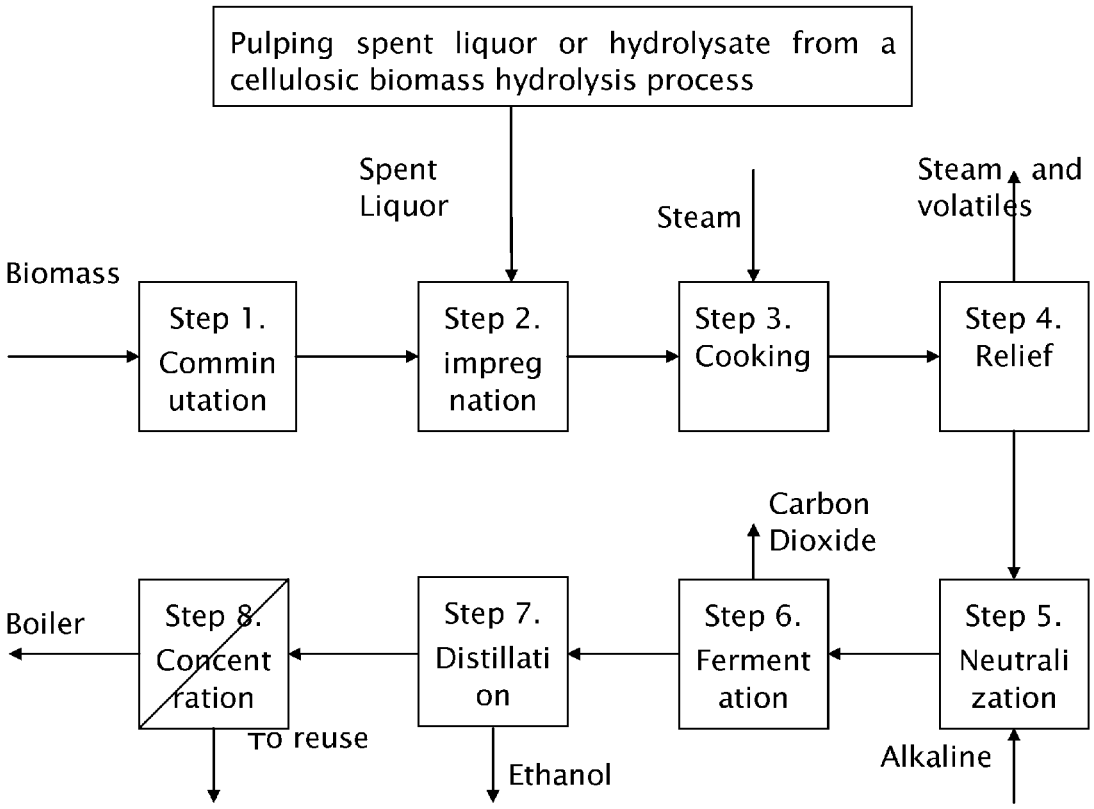
Illustration of a flow sheet example of the invention process, noting that the process steps may be in other sequences.

METHOD FOR HYDROLYSIS OF BIOMASS IN PULPING SPENT LIQUOR

PRIORITY DATA

This patent application is a non-provisional application claiming priority to provisional patent application No. 61/064,397, filed on Mar. 4, 2008.

DESCRIPTION

1. Field of the Invention

This invention relates, in general, to the hydrolysis of cellulosic and hemicellulosic material to produce fermentable sugars. The process utilizes pulping spent liquor as hydrolysis medium. The fermentable sugars are used as feedstock for a variety of chemical syntheses including alcohols, organic acids, polymers and other bioproducts.

2. Background of the Invention

Hydrolysis technologies to break down main biomass subcomponents, cellulose and hemicelluloses, have existed both in commercial practice and at the research level. The most prevalent of these are strong acid method taught by Farone, et al. (U.S. Pat. No. 5,597,714, Jan. 28, 1997) and two-stage dilute acid method as taught by Reitter (U.S. Pat. No. 4,427,453, Jan. 24, 1984).

Strong and dilute acid methods utilize preferably sulfuric acid to produce monomer sugars at reasonable yield. However, high temperature and/or long time cause formation of degradation products that inhibit fermentation. The main inhibitors are furfural and 5-hydroxylmethyl 2-furfaldehyde (HMF). The residual lignin forms condensed bonds limiting the viable uses as a chemical feedstock.

Sulfuric acid recovery was described by Lightner (U.S. Pat. No. 6,007,636, Dec. 28, 1999). Acid must be substantially purified and reheated in each cycle. The recovery cycle adds to processing complexity and cost.

Commercial sulfite pulping has been practiced since 1874. Sulfite pulping produces spent cooking liquor is termed spent sulfite liquor. Sulfite pulping recovery boiler is able to oxidize sulfur to sulfur dioxide, useful pulping chemical.

Fermentation of sulfite liquor to hemicellulosic ethanol has been practiced primarily to reduce the environmental impact of the discharges from sulfite mills since 1909. Published design data from one of the two known remaining sulfite mills that produces ethanol, shows ethanol yields not to exceed 33% of original hemicelluloses. Ethanol yield is low due to the incomplete hydrolysis of the hemicelluloses to fermentable sugars and further compounded by sulfite pulping side products, such as furfural, methanol, acetic acid and others, inhibiting fermentation to ethanol.

Because of poor ethanol yield, lower cost of synthetic ethanol production from oil feed stock, and the production of ethanol from corn today, only two sulfite mills are known to have continued the practice of hemicellulosic ethanol production to date.

In the mid-20$^{th}$ century, Kraft pulping eclipsed sulfite pulping as the dominant chemical pulping method. Kraft pulping process is performed in severe alkaline conditions, often causing severe degradation of hemicelluloses. Kraft pulping liquor is termed black liquor. Kraft pulping recovery boiler is able to reduce sulfur to sodium sulfide, useful pulping chemical.

Whittingham (U.S. Pat. No. 4,278,471, Jul. 14, 1981) taught us that process comprising stepwise addition sulfur dioxide and sulfuric acid to hydrolyze cellulose. This method yielded 96-97% of D-glucose from dried wood pulp.

U.S. Pat. No. 5,879,463 to Proenca reveals that simultaneous delignification and rapid hydrolysis of the entire cellulosic material, both the cellulose and the hemicelluloses, is possible in the presence of an organic solvent and a dilute inorganic acid.

In most pulping processes a major part of total consumed energy is used to heat and concentrate the pulping spent liquor. In the pulping process, the pulping spent liquor is separated in 10-20% solids concentration. Hemicelluloses and sugar concentration of the spent liquor is typically 1-10%. Pulping processes utilize multiple-effect evaporators to concentrate liquor further to combustion at 50-80% solids.

In corn ethanol processes the hydrolyzate is fed at approximately 30% sugar concentration. This enables fermentation to approximately 15%, nearer yeast tolerance at alcohol concentration of 21%. Therefore, the purification of ethanol and evaporation of water in production of distiller's grain from the residual solids requires less steam to evaporate water.

Therefore in the prior art of processing lignocellulosic material:

a) The pulping processes produce liquor at low concentration of sugars and their oligomers.
b) The evaporation of water from pulping spent liquor dilution water is major consumer of energy.
c) The grain and sugar cane based processes utilize high sugar concentrations to reduce the steam consumption.

The present inventors have now developed a process for the treatment of diverse biomass utilizing pulping spent liquor at low concentration to pretreat or completely hydrolyze cellulosic material, which increases sugar concentration from additional biomass and enables the utilization of woody and non woody biomass in the same process. This is achieved through cooking cellulosic material with sulfur dioxide and sulfuric acid in a weak pulping spent liquor in a one or multiple stage batch, semi continuous, or continuous process. Unfermented biomass is converted into additional combustion fuel in the mill steam generator.

Such hybrid process can multiply ethanol produced in a facility without appreciably increasing the energy consumption. Furthermore, unfermented biomass can be burned for energy and sulfur recovery can be implemented.

BRIEF SUMMARY OF THE INVENTION

The present invention describes a process of hydrolyzing cellulosic material with spent liquor which is derived from a pulping operation or is the hydrolysate of a more recalcitrant cellulosic feedstock, through a staged treatment using acid and/or SO2 and energy in one or multiple step process where:

Biomass is comminuted in a feedstock of discrete pieces ranging between dust and 3"—the feedstock the feedstock is impregnated in the spent liquor (which has been derived either from a pulping operation or the hydrolysis of a more recalcitrant biomass such as wood) containing dissolved wood solids and cooking chemicals;

Sulfur dioxide and volatiles are relieved upon heating the solution;

Acid is added to adjust liquor pH for the hydrolyzing period;

Sugar rich hydrolyzate is processed downstream including potentially being neutralized, cooled and fermented; and Unfermented biomass and chemicals are collected at high concentration for combustion or further downstream processing.

Hence in a preferred embodiment cellulosic material is treated in a first stage with pulping spent liquor, the cellulose is then hydrolyzed using acid. The resulting hydrolyzate is neutralized, fermented and ethanol is distilled. Distillation column bottoms are concentrated through evaporation and burned in a combustor to recover sulfur and energy. The condensate is used for pulp washing.

BRIEF DESCRIPTION OF THE DRAWINGS

A more complete understanding of the present invention may be obtained by reference to the following detailed description when read in conjunction with the accompanying drawings wherein:

FIG. 1. Illustrates a flow sheet example of the invention process, noting that the process steps may be in other sequences.

DETAILED DESCRIPTION OF THE INVENTION

A process for hydrolyzing cellulosic material into sugars through a staged treatment with spent liquor from another process—first step—and acid is described comprising the steps of:

Comminuting cellulosic biomass and feeding it in a reactor or atmospheric vessel containing hot spent liquor. Spent liquor may contain residual cooking base, sulfur compounds, lignin, hemicelluloses and their sugars at 5-20% total solids concentration. The resulting solution should have combined cellulose, hemicelluloses and sugar concentration in between 10% and 40%.

Heating the biomass and liquor after adjusting acidity to approximately pH=1 for duration from 5 minutes to 6 hours at temperature between 110° C. and 200° C. The acid is preferably sulfuric acid but could also be SO2 or an organic acid.

Neutralizing hydrolyzate to pH 5-6, where the cellulose in the biomass and hemicelluloses are substantially converted to their monomer sugars. Precipitated lignin may be separated for further processing.

Fermenting the hydrolyzate in between 10% and 40% sugar concentration in order to produce ethanol at approximately 2-20% concentration.

Distilling the ethanol at 2-20% concentration.

Evaporating or filtering to concentrate cooking chemicals and unfermented biomass for combustion in a steam generation and chemical recovery.

The first process step is "comminuting", element 1 in FIG. 1. The biomass may be bark, wood chips, sawdust, straw, corn stover, grass, waste paper or pulp. The feedstock is converted to uniform size by means of chipping or grinding.

The second process step is "impregnation" where the cellulosic material is introduced into the spent liquor. The impregnation may occur in the same vessel or separate vessel. Impregnation reduces the time of cooking step.

The third process step is "hydrolysis", which breaks the biomass cellulose and hemicelluloses by means of heat and acid. Direct or indirect steam may be used to heat the solution. Acid is preferably concentrated sulfuric acid so that it presents between 1 and 10% of the total solution volume, for example 1%, 2%, 3%, 4%, 5%, 6%, 7%, 8%, 9% or 10%

The fourth process step is "relief", where de digester pressure is let down to recover hot gases and deliver the solution out of the reactor. Hot gases are used for process heating elsewhere.

The fifth process step is "neutralization", where the hydrolyzate is prepared for fermentation. Hydrolyzate neutralized with alkaline, preferably lime or ammonium hydroxide, to near neutral pH, preferably pH 5. The lignin and suspended solids may be separated at this step by filtration.

The sixth process step is "fermentation", where micro-organisms convert sugars to a product ethanol, or other fermentation product. The produced solution is termed "beer" in the case of ethanol fermentation. The liquor is cooled or heated to appropriate temperature for the micro-organism. Carbon dioxide is released.

The seventh process step is "distillation" to remove and purify fermentation product from the beer. Distillation bottoms may contain lignin, dissolved solids and suspended solids. Membrane separation or pervaporation may be used in place of distillation The eighth process step is "concentration", where the distillation bottom solids concentration is increased above 50%. The concentration is performed in evaporator or filtration equipment. The resulting concentrated solution can be burned to recover energy and sulfur to the pulping process. Filtrate or condensate can be reused for the pulp mill stock washing.

Although other modifications and changes may be suggested by those skilled in the art, it is the intention of the inventors to embody within the patent warranted hereon all changes and modifications as reasonably and properly come within the scope of their contribution to the art.

The invention claimed is:

1. A process of hydrolyzing a cellulosic biomass feedstock into monomer sugars, said process comprising:

(a) providing a cellulosic biomass feedstock;

(b) providing spent liquor media containing dissolved solids and one or more sulfur-containing species selected from sulfur dioxide, sulfurous acid, or sulfuric acid, wherein said spent liquor media is derived from separate pulping or hydrolysis of a second cellulosic biomass material;

(c) impregnating said cellulosic biomass feedstock with said spent liquor media, to generate a mixture;

(d) adjusting the acidity of said mixture with an acid to reduce pH of said mixture; and (e) cooking said mixture to generate a hydrolyzate comprising monomer sugars derived from said cellulosic biomass feedstock.

2. The process of claim 1, wherein said cellulosic biomass feedstock contains hemicelluloses.

3. The process of claim 1, wherein said spent liquor media is spent pulping liquor from a pulping process.

4. The process of claim 1, wherein said spent liquor media is derived from hydrolysis of a second cellulosic biomass material having a higher recalcitrance compared to said cellulosic biomass feedstock.

5. The process of claim 1, wherein said spent liquor media is derived from separate pulping of said second cellulosic biomass material.

6. The process of claim 1, wherein said spent liquor media is derived from separate hydrolysis of said second cellulosic biomass material.

7. The process of claim 1, said process further comprising heating said mixture and releasing free sulfur dioxide and volatiles.

8. The process of claim 1, wherein said spent liquor media contains a sulfite selected from the group consisting of ammonium sulfite, calcium sulfite, sodium sulfite, magnesium sulfite, and any combinations thereof.

9. The process of claim 1, wherein said spent liquor media contains lignosulfonic acid.

10. The process of claim 1, wherein said spent liquor media contains an alcohol.

11. The process of claim 1, wherein said spent liquor media contains water, sodium sulfide, and sodium hydroxide.

12. The process of claim 1, wherein said acid in step (d) is selected from the group consisting of sulfuric acid, sulfur dioxide, an organic acid, and any combination thereof.

13. The process of claim 1, said process further comprising introducing a base to said hydrolyzate to increase pH of said hydrolyzate, and then fermenting said monomer sugars contained in said hydrolyzate to produce a fermentation product.

14. The process of claim 13, wherein said fermentation product is ethanol.

15. The process of claim 13, said process further comprising recovering said fermentation product.

16. The process of claim 1, wherein said cellulosic biomass feedstock contains lignin, and wherein said cooking in step (e) comprises sulfonating at least a portion of said lignin contained in said mixture.

17. The process of claim 1, said process further comprising removing lignin from said hydrolyzate.

18. A process of hydrolyzing a cellulosic biomass feedstock into monomer sugars, said process comprising:

(a) providing a cellulosic biomass feedstock;

(b) providing spent liquor containing dissolved solids and one or more sulfur-containing species selected from sulfur dioxide, sulfurous acid, or sulfuric acid, wherein said spent liquor media is derived from separate pulping or hydrolysis of a second cellulosic biomass material;

(c) impregnating said cellulosic biomass feedstock with said spent liquor, to generate a first mixture;

(d) heating said first mixture and releasing free sulfur dioxide and volatiles, to generate a second mixture;

(e) adjusting the acidity of said second mixture with an acid to reduce pH of said second mixture;

(f) cooking said second mixture to generate a hydrolyzate comprising monomer sugars derived from said cellulosic biomass feedstock; and (g) recycling and reusing at least some of said free sulfur dioxide from step (d).

19. The process of claim 18, wherein said spent liquor is spent pulping liquor from a pulping process.

20. A process of hydrolyzing a cellulosic biomass feedstock into monomer sugars, said process comprising:

(a) providing a first cellulosic biomass feedstock;

(b) providing spent liquor media derived from separate acid hydrolysis of a second cellulosic biomass feedstock having a higher recalcitrance compared to said first cellulosic biomass feedstock, wherein said spent liquor media contains dissolved solids and one or more sulfur-containing species selected from sulfur dioxide, sulfurous acid, or sulfuric acid;

(c) impregnating said first cellulosic biomass feedstock with said spent liquor media, to generate a mixture;

(d) adjusting the acidity of said mixture with an acid to reduce pH of said mixture; and (e) cooking said mixture to generate a hydrolyzate comprising monomer sugars derived from said cellulosic biomass feedstock.

21. The process of claim 20, said process further comprising heating said mixture and releasing free sulfur dioxide and volatiles.

* * * * *